US006648054B2

(12) United States Patent
Kuramasu et al.

(10) Patent No.: US 6,648,054 B2
(45) Date of Patent: Nov. 18, 2003

(54) DIE CASTING METHOD AND DIE CASTING MACHINE

(75) Inventors: Yukio Kuramasu, Shizuoka (JP); Osamu Yoshida, Kamakura (JP); Yoshihiro Tajima, Shizuoka (JP); Takaaki Ikari, Shizuoka (JP)

(73) Assignee: Nippon Light Metal Co., Ltd., Shinagawa-ku (JP)

( * ) Notice: Subject to any disclaimer, the term of this patent is extended or adjusted under 35 U.S.C. 154(b) by 0 days.

(21) Appl. No.: 10/169,865

(22) PCT Filed: Jan. 11, 2001

(86) PCT No.: PCT/JP01/00071

§ 371 (c)(1),
(2), (4) Date: Jul. 10, 2002

(87) PCT Pub. No.: WO01/51237

PCT Pub. Date: Jul. 19, 2001

(65) Prior Publication Data

US 2003/0041993 A1 Mar. 6, 2003

(30) Foreign Application Priority Data

Jan. 12, 2000 (JP) ..... 2000-003208

(51) Int. Cl.[7] ..... B22D 17/10; B22D 27/15

(52) U.S. Cl. ..... 164/61; 164/65; 164/113; 164/312

(58) Field of Search ..... 164/113, 312, 164/61, 65, 66.1, 253, 259

(56) References Cited

U.S. PATENT DOCUMENTS 5,860,468 A * 1/1999 Cook ..... 164/61
6,176,294 B1 * 1/2001 Kuramasu et al. ..... 164/61
6,308,766 B1 10/2001 Thurner

FOREIGN PATENT DOCUMENTS

| | | | |
|---|---|---|---|
| EP | 1 034 863 A | | 9/2000 |
| JP | 50-21143 | * | 7/1975 |
| JP | 55-8382 A | | 1/1980 |
| JP | 56-144855 A | | 11/1981 |
| JP | 57-140 | * | 1/1982 |
| JP | 1-46224 | * | 10/1989 |
| JP | 5-13649 U | | 2/1993 |

* cited by examiner

*Primary Examiner*—Kuang Y. Lin
(74) *Attorney, Agent, or Firm*—Smith Patent Office

(57) ABSTRACT

The present invention provides a die-casting method comprising the steps of evacuating a cavity 30 defined by dies of a die-casting machine to provide therein a vacuum of 100 millibar or less during a first period, injecting a reactive gas from a sleeve of the die-casting machine into the cavity 30 during a second period which has a partial overlap period with the first period and follows the overlap period, so as to increase the inner pressure of the cavity to atmospheric pressure or more, pouring a molten aluminum alloy M into the sleeve 40 while keeping the injection of the reactive gas, and subsequently moving a plunger 42 in the sleeve forward to forcibly inject the molten aluminum alloy from the sleeve into the cavity 30 while re-evacuating the cavity 30. The evacuation, reactive-gas injection and re-evacuation operations can be performed with respective overlap periods therebetween. During the operation of supplying the molten aluminum alloy, air and water are effectively discharged to outside, and the reactive gas in an unreacted state is discharged to outside without being incorporated into the molten aluminum alloy. Thus, the present invention provides a die-cast product having a significantly reduced volume of incorporated gases and allows the die-cast product to be applied to functional members.

10 Claims, 3 Drawing Sheets

DIE CASTING METHOD AND DIE CASTING MACHINE

BACKGROUND OF THE INVENTION

The present invention relates to a die-casting method and machine for manufacturing a die-cast product usable as not only structural members but also functional members by virtue of its suppressed cast defects such as internal porosities or blowholes.

In a conventional die-casting method, molten aluminum or molten aluminum alloy (hereinafter correctively referred to as "molten metal") poured into a sleeve of a die-casting machine is forcibly injected into a cavity defined in dies by a plunger in the sleeve. While most of gases, such as air or water vapor, residing in the cavity are purged from the cavity in conjunction with the injection of the molten aluminum, a part of the gases can be undesirably left in the cavity after the completion of the injection of the molten aluminum alloy. Particularly, a die assembly designed for a specific product having a very thin thickness or a complicated configuration can involve narrowed portions constraining fluid flow, and thereby it is difficult to achieve complete exclusion of gases residing in its die cavity.

During a cooldown/solidification stage of the injected molten aluminum in the dies, the residual gases in the cavity are took in the molten aluminum and incorporated into the resulting die-cast product as a factor of casting defects such as internal porosities or blowholes. As a result, the obtained die-casting products have suffered from inferiority in mechanical properties such as strength or elongation, resulting in unfavorable evaluation for being inadequate to use as functional components, such as a scroll, piston, cylinder block, connecting rod or suspension member. If such casting defects caused by the residual gases are suppressed, the die-casting method will have enlarged range of applicable fields with its intrinsic excellent productivity.

There has been known a vacuum die-casting method as one of techniques intended to eliminate the adverse effect of the residual gases. In the vacuum die-casting method, a die cavity is evacuated prior to a forcible injection of molten aluminum in order to remove air from the cavity. However, in this method, the internal pressure of the cavity has a limited vacuum ranging from 200 to 500 millibar and it is practically impossible to obtain further reduced vacuum, because some ambient air enters in the cavity through a gap between mating faces of dies and another ambient air is additionally introduced in a sleeve of a die-casting machine during the operation of pouring the molten aluminum into the sleeve. Thus, even though a product obtained from the vacuum die-casting method has a reduced volume of incorporated air as compared with products from another conventional die-casting method, it is still involved with the casting defects such as internal porosities caused by the incorporated gases, and is thereby quite inadequate to use as functional components.

An oxygen die-casting method has been developed to eliminate the disadvantage of the vacuum die-casting method (see Japanese Patent Publication No. 50-21143). In the oxygen die-casting method, oxygen gas is filled in a die cavity with a pressure of atmospheric pressure or more to replace gases in the cavity by the oxygen gas. Thus, an excessive part of the supplied oxygen gas is blown out of the cavity through a gap between mating faces of dies and a pour opening for pouring molten aluminum therethrough to prevent ambient air from entering in the cavity through the gap and the pour opening. The supplied oxygen gas remaining in the cavity reacts with the molten aluminum to form a fine structure of $Al_2O_3$ dispersed over the resulting die-cast product without any adverse effect on the properties of the product.

However, even by supplying the oxygen gas into the cavity with the pressure of atmospheric pressure or more, it is difficult to completely remove air from the cavity. Generally, a die cavity having a complicated configuration leads to an increased volume of residual air therein. More specifically, the die cavity having a complicated configuration involves a narrowed portion incapable of receiving therein the supplied oxygen gas, and the narrowed portion keeps gases such as air and water vapor residing therein without replacing the gases by the supplied oxygen gas. These residual gases are incorporated into the resulting die-cast product as a factor causing the casting defects.

The residual air in the cavity as a factor causing the casting defects can be effectively replaced by oxygen gas by injecting the oxygen-gas simultaneously with the evacuation of the cavity (Japanese Patent Publication No. 57-140). However, even if the oxygen gas is injected in synchronous with the evacuation of the cavity, water is not effectively removed from the cavity. In fact, a die-cast product obtained from this technique is still involved with the cast defects caused by the residual gases. A technique of injecting oxygen gas after the evacuation of the cavity has been also known (Japanese Patent Publication No. 1-46224). However, this technique cannot sufficiently suppress the casting defects caused by the residual gases, because the inner pressure of the die cavity is maintained merely at a vacuum ranging from about 200 to 400 millibar.

In view of the above circumstance, the inventors has developed a die-casting method comprising the steps of evacuating a die cavity to a vacuum of 100 millibar or less, then injecting a reactive gas such as oxygen gas into the cavity, and initiating a forcible injection of molten aluminum alloy at a time the internal pressure of the cavity is increased to atmospheric pressure or more (Japanese Patent Application No. 11-154566). Evacuating the cavity to the vacuum of 100 millibar or less accelerates vaporization of water from a release agent attached on the inner surfaces of dies. Subsequently supplying the reactive gas to the evacuated cavity allows the reactive gas to be spread all over the interior of the dies, so as to effectively purge the residual air and the water from the release agent as well as other undesirable gases in the cavity. Thus, a die-cast product can be obtained with a significantly reduced volume of incorporated gases, and thereby the casting defects caused by the residual gases can be suppressed. In addition, the die-cast product can be heated without generation of blisters caused by the residual gas. This allows the die-cast product to be improved in its mechanical properties through a heat treatment such as a T6 treatment.

Most of the reactive gas supplied to the cavity reacts with the molten aluminum ally injected into the cavity to form a fine structure of $Al_2O_3$ dispersed over the resulting product, and a part of the reactive gas is pushed out of the cavity by the molten aluminum alloy forcibly injected into the cavity. However, depending on the configuration of an intended die-cast product, a part of the reactive gas can be left in the cavity after the completion of the injection of the molten aluminum alloy. Then, the residual reactive gas is undesirably incorporated into the die-cast product without effective reaction with the molten aluminum alloy or in an unreacted state. For instance, in dies intended to manufacture a die-cast product having a complicated configuration, its cavity is typically designed to have a configuration in which a metal flow channel are branched into plural channels and the plurality of channels are jointed together. This junction area creates a dead-end-like portion where a path for pushing out the reactive gas therethrough is clogged by the respective metal flows in the jointed channels to trap the reactive gas.

A system operable to evacuate a die cavity by opening a bypass passage in fluid communication with the cavity (Japanese Patent Publication No. 1-46224) has a limited vacuum ranging from 200 to 400 millibar in the cavity for the following reasons, resulting in a substantial volume of residual air and insufficient purge of the reactive gas in an unreacted state, which leads to insufficient reduction of gases incorporated in a die-cast product.

First, the system is operated to evacuate gases directly from the cavity. Thus, it is required to spend substantial time for evacuating gases from sleeve and runner regions through narrow gates. Further, the system is operated to evacuate gases initially from the cavity. Thus, the resultingly reduced pressure facilitates vaporization of a sleeve lubricant and then sucks the vaporized sleeve lubricant into the cavity, resulting in increased humidity in the cavity. This high humidity can provide water capable of reacting with molten aluminum alloy injected into the cavity to form hydrogen to be incorporated into a die-cast product. A part of the sleeve lubricant can also be sucked into the cavity in a liquid state to cause contamination in the cavity.

Secondly, the system includes an evacuation device adapted to be selectively brought into fluid communication with the cavity through a valve device. That is, if the evacuation operation is continued until the completion of the operation of injecting the molten aluminum alloy, the molten metal can run in the evacuation device through a gap of the opened valve. Thus, it is required to terminate the evacuation of the cavity by shutting the valve before the molten aluminum alloy reaches the valve. As a result, the residual gases cannot be sucked until the completion of the operation of injecting the molten aluminum alloy, and the reactive gas in an unreacted state tends to be left in the cavity.

Further, the evacuation operation and the reactive-gas injection operation are performed by use of a common opening. In other words, it is impossible to inject the reactive gas simultaneously with the evacuation of the cavity, and thereby the reactive gas will be injected after terminating the evacuation of the cavity. Thus, after the termination of the evacuation, some ambient air can enter into the cavity through a gap between mating faces of the dies and tends to remain therein. In addition, since the opening for injecting the reactive gas is provided only in the cavity, the sleeve cannot be filled with the reactive gas, which undesirably allows ambient air to enter into the cavity through a gap between the sleeve and the tip of the plunger.

DISCLOSURE OF THE INVENTION

The present invention has been made to solve the aforementioned problems. It is therefore an object of the present invention to provide an improved vacuum-oxygen die-casting method capable of utilizing both advantages of the conventional vacuum and oxygen die-casting methods and obtaining a die-cast product usable as not only structural members but also functional members, by re-evacuating a die cavity through an overflow region and a runner or sleeve of a die-casting machine during an operation of forcible injecting molten aluminum to discharge a reactive gas in an unreacted state from the cavity so as to achieve a significantly reduced volume of gases incorporated into the die-cast product as compared with conventional die-casting products.

In order to achieve this object, according the present invention, there is provided a die-casting method comprising the steps of evacuating a cavity defined by dies of a die-casting machine to provide therein a vacuum of 100 millibar or less during a first period, injecting a reactive gas from a sleeve of the die-casting machine into the cavity during a second period which has a partial overlap period with the first period and follows the overlap period, so as to increase the inner pressure of the cavity to atmospheric pressure or more, pouring a molten aluminum alloy into the sleeve while keeping the injection of the reactive gas, and subsequently moving a plunger in the sleeve forward to forcibly inject the molten aluminum alloy from the sleeve into the cavity while re-evacuating the cavity.

Preferably, the evacuation is performed at a suction speed of 500 millibar/second or more. The cavity may be evacuated through an evacuation passage opened to a runner region in dies of a die-casting machine, optionally in combination with an evacuation passage opened to an overflow region in the dies. The reactive gas such as oxygen gas is injected into the cavity during the time-period which has the partial simultaneous period with the evacuation period and follows the simultaneous period, so as to increase the inner pressure of the cavity to atmospheric pressure or more. In this reactive-gas injection operation, it is preferable to inject a dehumidified reactive gas to keep the cavity in humidity of 15% RH or less. The reactive-gas injection operation may be terminated before the plunger is moved forward or may be continued until the completion of an entire die-casting operation.

Molten aluminum alloy to be cast is poured from a pour opening of the sleeve to the interior of the sleeve and then forcibly injected into the cavity by the forward movement of the plunger. Preferably, during this molten-aluminum-alloy injection operation, the plunger is temporarily stopped just after the plunger tip passes over the pour opening of the sleeve.

The re-evacuation operation may be initiated after the completion of the operation of pouring the molten aluminum alloy, and continued until the completion of the entire die-casting operation. During the re-evacuation operation, the cavity is evacuated through the gas passage opened to the overflow region, optionally in combination with the gas passage opened to the runner region.

The present invention also provides a die-casting machine suitable for the above method. The die-casting machine comprises: an evacuation device having a discharge passage opened to a runner region which guides molten aluminum alloy poured into a sleeve to a cavity defined by dies, and a gas passage opened to an overflow region in the dies; and a reactive-gas supply device having a gas supply passage opened to a gas inlet provided in the sleeve closer to the dies than a pour opening for pouring the molten aluminum alloy into the sleeve therethrough.

Preferably, a chill vent is provided between the opening of the gas passage and the overflow region, to prevent the molten metal from leaking to the evacuation device. An applicable technique for assuring air-tightness between the cavity and ambient air may include a packing interposed between respective mating faces of stationary and movable dies of the die-casting machine with surrounding the cavity, and a groove which is formed in at least one of the mating faces of the stationary and movable dies with surrounding the cavity and is in fluid communication with the evacuation device. Further, in order to assure air-tightness for an ejector pin slidably inserted in a pin insertion hole which is penetratingly provided in the movable die and opened to the cavity, it is effective to provide a sealing device between the inner surface of the pin insertion hole and the outer surface of the ejector pin.

The gas passage opened to the overflow region may be branched into a discharge passage selectively brought into fluid communication with the evacuation device and an air supply passage selectively brought into fluid communication with a compressed-air supply device, in order to use the gas passage commonly for evacuating the cavity and supplying a compressed air. A pressure gage for measuring the internal pressure of the cavity and a hygrometer for measuring humidity in the cavity may be provided at the gas passage. Preferably, a drier is interposed in the gas supply passage extending from the reactive-gas supply device to the gas inlet of the sleeve.

In the conventional die-casting methods, gases contained in a die-cast product are derived from a residual air in a die cavity. The volume of the residual air can be significantly reduced by the vacuum method or the oxygen die-casting method. However, even if the residual air in the cavity is reduced, a die-cast product obtained from such methods is ineluctably involved with the casting defects caused by the residual gases. In the vacuum-oxygen die-casting method proposed by Japanese Patent Application No. 11-154566, the internal pressure of the cavity is reduced down to the vacuum of 100 millibar or less during the evacuation operation to facilitate vaporization of water from a release agent or the like, and then the reactive gas is supplied to the evacuated cavity to distribute the reactive gas all over the cavity. By supplying the reactive gas to increase the inner pressure of the cavity to atmospheric pressure or more, ambient air is prevented from entering into the cavity, and the water vapor from the release agent is advantageously effused to outside.

In order to depressurize the cavity to the vacuum of 100 millibar or less during the evacuation operation, it is required to provide an airtight structure for the mating faces of the dies, the pour opening and the overflow region. The airtight structure also acts to reliably hold the injected reactive gas in the cavity during the subsequent reactive-gas injection operation so as to keep the cavity in an oxygen atmosphere having a pressure of atmospheric pressure or more. The injected reactive gas does not react altogether with the molten aluminum alloy to form $Al_2O_3$, but a part of the reactive gas remains in an unreacted state in the cavity. The unreacted reactive gas is pushed into the overflow region by the molten aluminum alloy forcibly injected into the cavity. However, depending on the configuration of the die cavity, a path for pushing out the unreacted reactive gas can be clogged by the metal flows. In this case, a part of the unreacted reactive gas will be incorporated into a die-cast product. This tendency is strongly developed in a die cavity having a configuration in which metal flow channels are complicatedly branched and jointed.

In the present invention, the gas passages opened to the overflow and runner regions are selectively brought into fluid communication with the evacuation device to evacuate the reactive gas from the cavity during the molten-aluminum-alloy injection operation. Thus, the volume of the unreacted gas incorporated in the molten aluminum alloy is significantly reduced. Further, the evacuation is performed through the gas passage opened to the overflow region. This allows the reactive gas to be injected simultaneously with the evacuation operation, and allows the unreacted reactive gas to be continuously discharged until the completion of the molten-aluminum-alloy injection operation. Thus, the volume of the residual unreacted gas in the cavity will be significantly reduced. During the above evacuation operation, the runner region may be additionally evacuated through the gas passage opened thereto.

Since the unreacted reactive gas is sucked based on evacuation, paths in fluid communication with the evacuating device to evacuate the unreacted reactive gas from the cavity are quickly established before such paths are clogged by the metal flows. Thus, the unreacted reactive gas is not confined in the paths. Further, the runner region can be evacuated just before the molten aluminum alloy enters in the runner region.

In this respect, the technique of directly evacuating an unreacted reactive gas from a die cavity through the bypass passage opened to the cavity, (Japanese Patent Publication 1-46224) cannot achieve the vacuum of 100 millibar or less during the evacuation operation. Thus, it is difficult to prevent the entry of ambient air and the remanence of the unreacted reactive gas, and consequently a die-cast product having a complicated configuration is often involved with the casting defects caused by the unreacted reactive gas.

BEST MODE FOR CARRYING OUT THE INVENTION

With reference to the drawings, the present invention will now be described in conjunction with a specific embodiment.

A die-casting method according to an embodiment of the present invention comprises the steps of evacuating a cavity defined by dies of a die-casting machine to provide therein a vacuum of 100 millibar or less, then injecting oxygen gas into the cavity to increase the inner pressure of the cavity to atmospheric pressure or more, and forcibly injecting molten aluminum alloy while re-evacuating the cavity (hereinafter referred to as "DVO process").

Figure 1:
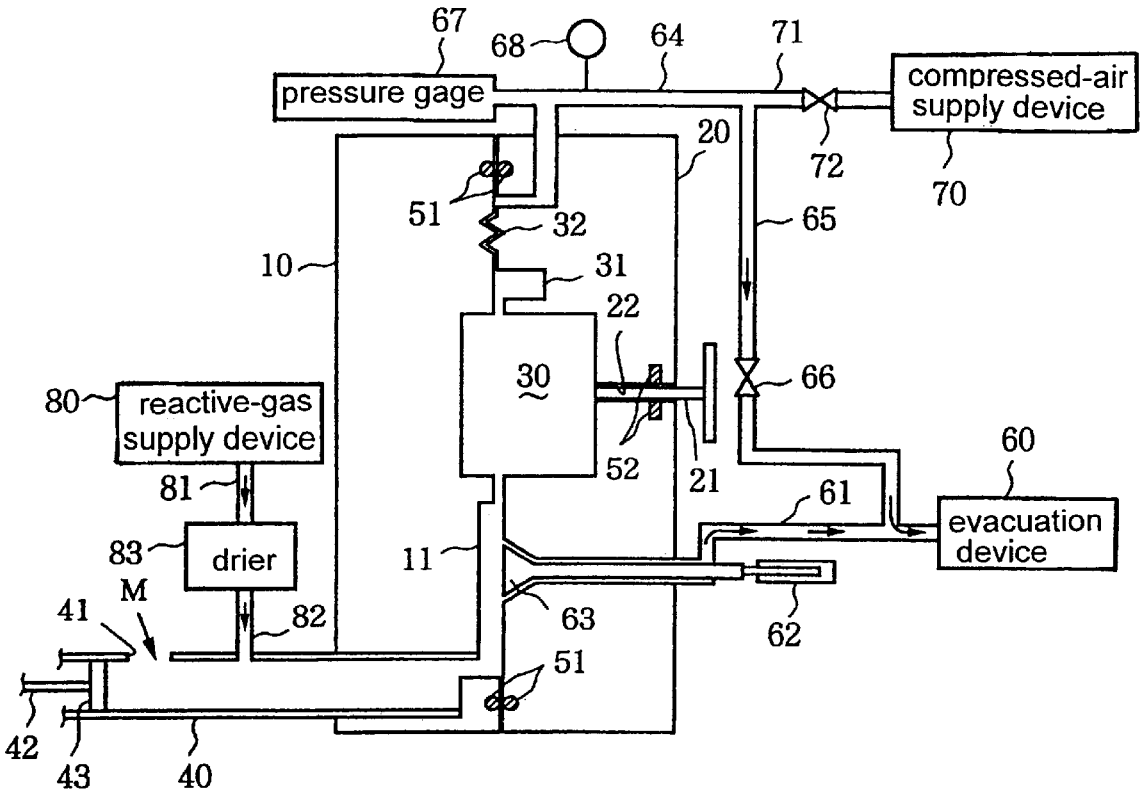
FIG. 1 is a schematic diagram of a die-casting machine employing a vacuum device and a reactive-gas supply device.
Figure 2:
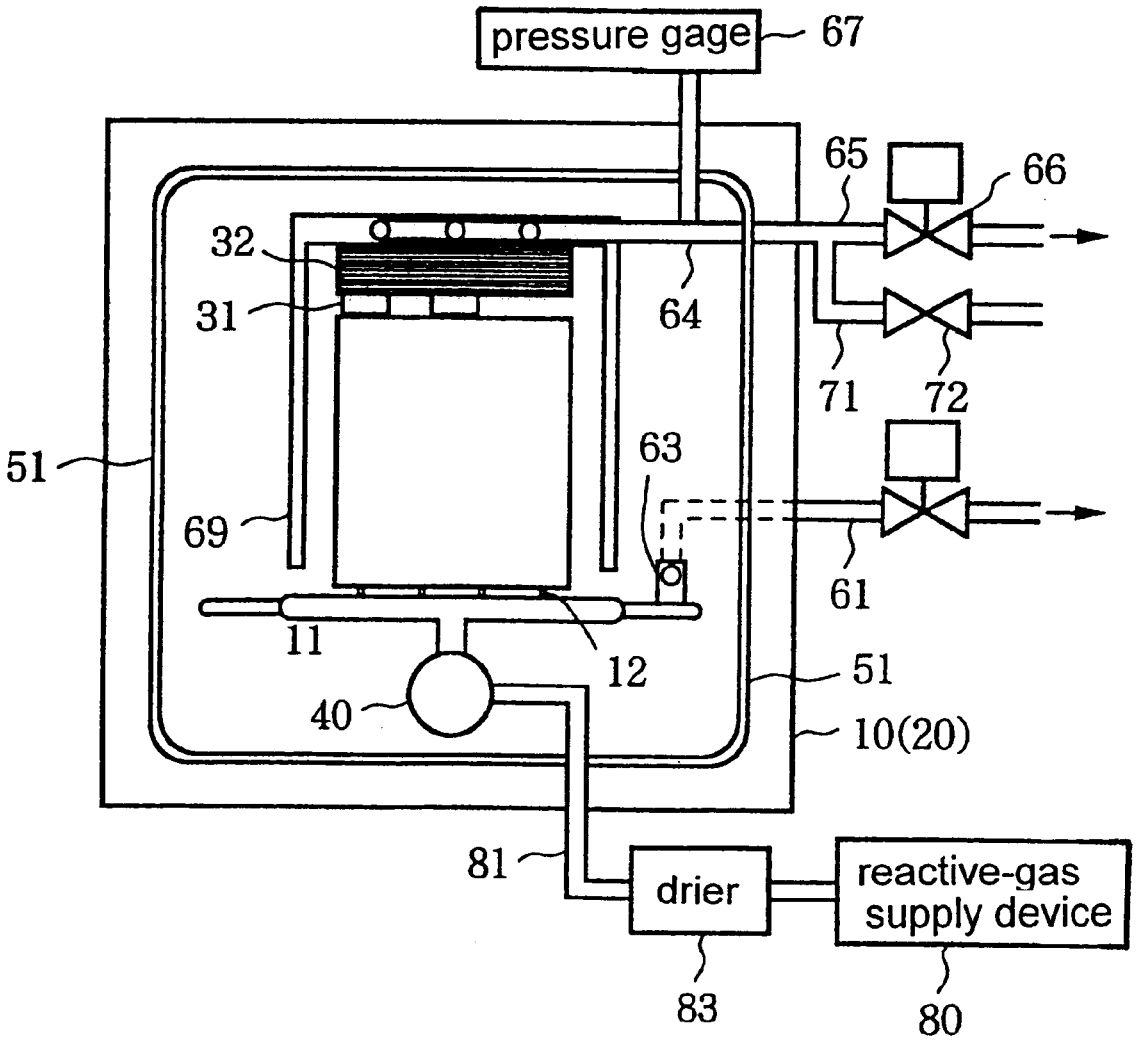
FIG. 2 is a schematic sectional view of the die-casting machine of FIG. 1, viewed from the axial direction of a plunger thereof.

FIG. 1 schematically shows an exemplary die-casting machine used to implement the DVO process. A cavity 30 is defined between a stationary die 10 and a movable die 20 to form a profile corresponding to the configuration of an intended product. A runner 11 is formed in the stationary die 10. The runner 11 is in fluid communication with a sleeve 40 to allow a molten aluminum alloy M poured from a pour opening 41 into the sleeve 40 to be forcibly injected into the cavity 30 by a plunger 42. A plurality of gates 12 (FIG. 2) are formed in accordance with the configuration of the intended product and provides fluid communication between the runner 11 and the cavity 30 to allow the molten aluminum alloy M to be distributed over adequate portions of the cavity 30.

The cavity 30 includes an overflow portion 31 formed in the mating face of the stationary or movable die 10, 20. A chill vent 32 is provided outside the overflow portion 31. The overflow portion 31 acts to stabilize the flow of the molten aluminum alloy M in the cavity 30. As illustrated, the chill vent 32 is formed by providing a rugged or wavy shaped portion in a part of the mating face of each of the stationary and movable dies 10 and 20, and acts to facilitate solidification of the molten aluminum alloy M to be brought into contact therewith so as to prevent the molten aluminum alloy M from being sucked toward an after-mentioned evacuation device. By virtue of the chill vent 32, the cavity 30 can be evacuated without run-in or leakage of the molten aluminum alloy M during the injecting the molten aluminum alloy M.

An ejector pin 21 is provided movably or slidably in the movable die 20 to release a die-cast product therefrom.

A packing 51 such as an O-ring is interposed between the mating faces of the stationary and movable dies 10 and 20 to keep the cavity 30 airtight against ambient air. The packing 51 is fitted in a groove surrounding the cavity 30 to sealingly prevent ambient air from entering through a gap between the stationary and movable dies 10 and 20. Another packing 52 is provided at a pin insertion hole 22 into which the ejector pin 21 is slidably inserted. The packing 52 acts to maintain air-tightness between the inner surface of the pin insertion hole 22 and the outer surface of the ejector pin 21. These packings 51 and 52 provide an effective sealing effect allowing the cavity 30 to be depressurized to the vacuum of 100 millibar or less and to be evacuated during the operation of injecting the molten aluminum alloy M.

In order to provide an enhanced effect on preventing ambient air from entering into the cavity, the groove having the packing 51 received therein may be brought into fluid communication with and evacuated by an evacuation device 60. In addition to the groove having the packing 51 received therein, an evacuation groove 69 (FIG. 2) without any packing may be provided in at least one of the mating faces between the stationary and movable dies 10 and 20 with surrounding the cavity 30, and may be brought into fluid communication with and evacuated by to the evacuation device 60.

A discharge passage 61 in fluid communication with the evacuation device 60 is opened to the runner 11 to evacuate the cavity 30. A vacuum valve 63 is provided at the opening of the discharge passage 61 facing to the runner 11. The vacuum valve 63 is actuated by a driving cylinder 62 to open and close the opening. Another discharge passage 65 is branched from a gas passage 64 opened at a position between the chill vent 32 and the packing 51 on the mating surfaces of the stationary and movable dies 10 and 20. The discharge passage 65 is brought into fluid communication with the evacuation device 60 through a vacuum valve 66.

A pressure gage 67 is provided at the gas passage 64 to detect the internal pressure of the cavity 30. Preferably, a hygrometer 68 is provided at the gas passage 64 to control humidity in the cavity 30.

An air supply passage 71 is branched from the gas passage 64 and brought into fluid communication with a compressed-air supply device 70 through a check valve 72. Thus, the gas passage 64 is also used to supply a compressed air into the cavity 30. When the dies are opened after the completion of an entire die-casting operation, a compressed air is supplied through the gas passage 64 to remove foreign substances from the passages and the like associated with the evacuation.

A reactive-gas supply device 80 is provided to inject a reactive gas such oxygen gas into the cavity after evacuating the cavity 30 in the DVO process. The reactive gas is supplied into the sleeve 40 from the reactive-gas supply device 80 through a gas supply passage 81 and a gas inlet 82. A drier 83 is interposed in the gas supply passage 81 to dehumidify the reactive gas and keep the cavity 30 in lower humidity.

The internal pressure and humidity in the cavity are detected, respectively, by the pressure gage 67 and the hygrometer 68 which are provided at the gas passage 64. The detected value from the pressure gage 67 is sent to a control unit for controlling respective operations of the evacuation device 60, the compressed-air supply device 70 and the reactive-gas supply device 80, to control the evacuation, oxygen-gas injection and re-evacuation periods. The control unit is also adapted to initiate the supply of molten aluminum alloy M to the sleeve 40, at the time the detected value from the hygrometer 68 is 15% RH or less and the internal pressure in the cavity 30 is atmospheric pressure or more.

The DVO process according to the present invention will be described below.

Figure 3:
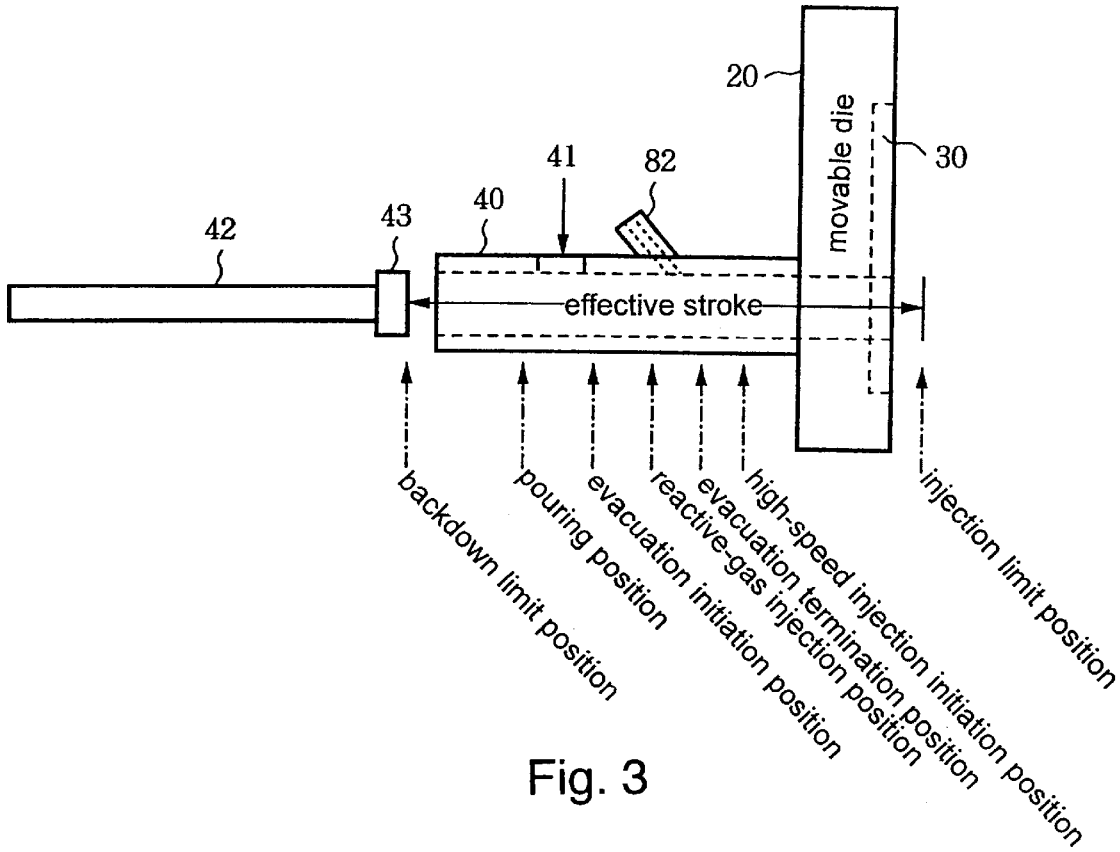
FIG. 3 is an explanatory view of the operating positions of the plunger.

The movable and movable dies 10 and 20 are clamped, and then the cavity 30 is evacuated through the runner 11. The cavity 30 is also evacuated by using the gas passage 64 opened to the mating faces between the chill vent 32 and the packing 51. The evacuation operation is continued until the pressure gage 67 detects that the internal pressure of the cavity 30 is reduced down to a vacuum of 100 millibar or less. During the evacuation operation, the plunger tip 43 is located at a given position, or an evacuation initiation position, between the pour opening 41 and the gas inlet 82 of the sleeve 40 to prevent ambient air from sucking into the sleeve through the pour opening 41 (FIG. 3). Since the evacuation is performed through the runner 11, a lubricant in the sleeve 40 is discharged to outside without entering in the cavity 30.

During the evacuation operation, the suction speed is preferably arranged at 500 millibar/second or more. Even if the cavity 30 has a complicated configuration, the suction speed of 500 millibar/second or more allows undesirable gases to be removed from all over the cavity 30. Further, when the cavity 30 is evacuated at the suction speed of 500 millibar/second or more, water contained in a release agent attached on the inner surface of the dies 10, 20 is effectively purged by virtue of a bumping phenomenon, and thereby the water in the cavity 30 is significantly reduced.

Preferably, the evacuation operation is continued for about 1 to 2 seconds while isolating the pour opening port 41 from the cavity by the plunger 42. In this respect, the time-period of the evacuation is arranged relatively longer as compared with the conventional vacuum die-casting method in which the evacuation period is less than 1 second without isolating the pour opening from the cavity. The inner pressure of the cavity 30 is reduced down to the vacuum of 100 millibar or less during the evacuation operation. The water contained in the release agent on the inner surface of the dies is separatedly vaporized and discharged from the cavity 30 to outside by the evacuation.

The conventional evacuation having the vacuum higher than 100 millibar is involved with a relatively large volume of air remaining in the cavity 30. The residual air is insufficiently replaced by a reactive gas during the subsequent reactive-gas injection operation and is incorporated into a die-cast product, resulting in occurrence of casting defects such as blowholes or blisters. On the other hand, the ultimate vacuum of 100 millibar or less can effectively facilitate vaporizing the water contained in the release agent or the like and discharging the resulting water vapor to outside. In particular, when the evacuation is performed at a suction speed of 500 millibar/second or more, the vaporization of the water in the release agent or the like is accelerated by the bumping phenomenon, and thereby the residual water is significantly reduced. In view of the ability of the evacuation device, the maximum suction speed would be about 800 millibar/second.

After the cavity 301 is evacuated to the vacuum of 100 millibar or less, a reactive gas is injected from the gas inlet 82 to the cavity 30. The reactive-gas injection period has a partial overlap period with the evacuation period, and the evacuation operation is terminated after the completion of the overlap period. During this partial overlap period, the injected reactive gas is distributed all over the cavity 30, and ambient air is prevented from entering into the cavity through the gap between the mating faces of the dies. The reactive gas injection operation is continued until the pressure gage 67 detects that the internal pressure of the cavity 30 is increased to the atmospheric pressure or more.

During the reactive-gas injection operation, humidity in the cavity 30 is measured by the hygrometer 68 and is controlled so as not to go over 15% RH. This humidity control can reduce the amount of water which enters into the cavity 30 together with the reactive gas and generates hydrogen gas by reacting with the molten aluminum alloy M. Preferably, the reactive gas is passed through the driers 3, and the dried reactive gas is injected into the cavity to reduce humidity in the cavity 30

After the internal pressure of the cavity 30 is increased to atmospheric pressure or more, the plunger tip 43 is moved backward to a molten-aluminum-alloy pouring position (FIG. 3) for providing fluid communication between the pour opening 41 and the cavity. Then, the molten aluminum alloy M is poured into the sleeve 40 in a mount necessary for one shot or one die-casting operation. Since the internal pressure of the cavity 30 is kept at the atmospheric pressure or more during this poring operation, the reactive gas is blown out through the pour opening 41 to prevent ambient air from entering in the sleeve. After the completion of the operation of pouring the molten aluminum alloy M, the fluid communication between the pour opening 41 and the cavity 30 is blocked by moving the plunger 42 forward.

After the pouring operation, the cavity 30 is re-evacuated through the overflow portion 31. This re-evacuation may be performed in combination with the evacuation through the discharge passage 61 opened to the runner 11. Preferably, the re-evacuation period is arranged to have a partial overlap period with the reactive-gas injection period. The reactive-gas injection operation may be continued until the completion of the entire die-casting operation. During this overlap period, an excessive reactive gas is discharged from the cavity 30 to outside, and water from the release agent and/or lubricant is discharged from the cavity 30 together with the reactive gas. This also eliminates the disadvantage, or ambient-air entry, likely caused by re-evacuating after the completion of the reactive-gas injection operation (Japanese Patent Publication No. 1-46224).

The plunger 42 is moved forward at a low speed until the plunger tip 43 passes over the pour opening 41 and reaches a given position, or a high-speed injection initiation position, for initiating a high-speed injection (FIG. 3), while re-evacuating the cavity 30. In the course of the forward movement of the plunger 42, the re-evacuation operation is initiated at a time the plunger tip 43 reaches at the aforementioned evacuation initiation position. The forward movement of the plunger 42 may be temporarily stopped at the evacuation initiation position. The temporary stop of the plunger 42 provides a longer evacuation period corresponding to the stop period to allow undesirable gases and water vapor to be further discharged from the cavity 30.

Then, the plunger 42 is moved forward at a high speed from the high-speed injection initiation position to an injection limit position to forcibly inject the molten aluminum alloy M into the cavity 30. Since the cavity 30 is continuously evacuated during this molten-aluminum-alloy injection operation, the reactive gas in an unreacted state is effectively removed from the cavity 30 as the molten aluminum alloy M is forcibly injected into the cavity. Even if the cavity 30 has a configuration in which a plurality of metal flow channels are complicatedly branched and joined, desirable flow paths of the reactive gas are quickly established to provide fluid communication with the evacuation device. Thus, the flow paths in fluid communication with the evacuation device are not clogged by the molten aluminum alloy, which prevents the unreacted reactive gas to be trapped by and incorporated into the molten aluminum alloy. The re-evacuation operation is continued until the cavity 30 is filled with the molten aluminum alloy M.

After the completion of a die-casting operation, the re-evacuation operation is terminated, and then the dies are opened. Then, a compressed air is supplied from the compressed-air supply device 70 through the air supply passage 71 and the gas passage 64 to remove foreign substances from the passages and the like associated with the evacuation.

By arranging the timings between the evacuation, reactive-gas injection and re-evacuation operations as described above, residual gases and unreacted reactive gas are sufficiently removed from the cavity 30. Further, the reactive gas in the cavity 30 adequately reacts with the molten aluminum alloy M to provide a die-cast product having a less volume of incorporated gases. The obtained die-cast product has a significantly reduced volume of gases, and thereby can be subjected to a heat treatment such as a T6 treatment to provide enhanced mechanical properties without blisters caused by expansion of these gases.

EXAMPLE 1

An example will be described in which the present invention is applied to a die-casting machine with dies adapted to define a thin-box-shaped cavity 30 having a plurality of ribs partitioning the interior thereof and a cooling device capable of partially water-cooling the dies.

Dies were prepared in which an ejector pin 21 and a pin-insertion hole 22 are air-tightly sealed therebetween and respective mating faces of stationary and movable dies 10 and 20 are air-tightly sealed with a packing 51, and the dies were then installed in a die-casting machine. The dies were heated to 180 degrees centigrade, and a release agent was applied on the inner surfaces of the dies for 5 seconds.

Then, a pour opening 41 of a sleeve 40 was isolated from the cavity by a plunger 42, and gases were evacuated from the cavity 30 and the sleeve 40 through a discharge passage 61 and a gas passage 64 at a suction speed of 700 millibar/second for 1.5 seconds. The evacuation operation was continued until a pressure gage 67 indicates a pressure of 75 millibar.

Oxygen gas or a reactive gas is injected from a reactive-gas supply device 80 into the sleeve 40, while keeping the evacuation. The evacuation operation was terminated after the lapse of 2 seconds from the initiation of the oxygen gas injection, while the oxygen gas was continuously injected until the internal pressure of the cavity 30 is increased to the atmospheric pressure or more.

After atmospheric pressure or more of the internal pressure and 15% RH or less of the humidity in the cavity 30 were confirmed, respectively, by the pressure gage 67 and a hygrometer 68, the plunger 42 was moved backward to provide fluid communication between the pour opening 41 and the cavity, and then molten aluminum alloy M was poured into the sleeve 40. The oxygen-gas injection operation was continued during the molten-aluminum-ally pouring operation. Subsequently, the oxygen-gas injection operation was terminated just after the sleeve 40 was completely filled with the molten aluminum alloy M or was uninterruptedly continued until the completion of an entire die-casting operation.

After the molten aluminum alloy M was poured into the sleeve 40, the plunger 42 was moved forward to a high-speed-injection initiation position (FIG. 3) and then stopped thereat for 1 second. The plunger 42 was then moved forward at a high speed to forcibly inject the molten aluminum alloy M into the cavity 30 at an injection speed of 3 m/second. During the operation of injecting the molten aluminum alloy M, the cavity 30 was re-evacuated through the discharge passage 64 and the gas passage 64, and the re-evacuation was terminated after the completion of the entire die-casting operation.

The dies were opened after the lapse of 20 seconds from the completion of the entire die-casting operation, and then a compressed air was supplied from the compressed-air supply device 70 to clean up the inside of the gas passage 64. Then, a resulting die-cast product was taken out of the dies by sticking out the ejector pin 21.

Table 1 shows respective timings of the evacuation, oxygen gas injection, and re-evacuation operations in the aforementioned DVO process together with the operations of pouring and forcibly injecting the molten aluminum alloy M, based on the lapsed time from the initiation of the evacuation operation. The process in Example 3 includes a step of temporarily stopping the plunger 42, and thus has a longer period between the completion of pouring the molten metal in the sleeve 40 and the initiation of forcibly injecting the molten metal into the cavity 30, corresponding to the stop period, as compared with Example 1 and 2. Table 1 also shows Comparative Example 4 in which the evacuation, oxygen gas injection and re-evacuation operations were sequentially switched without any overlap period therebetween.

TABLE 1

| | Lapsed Time in each Die-Casting Operation (sec) | | | |
|---|---|---|---|---|
| | Inventive Example | | | Comparative Example |
| operation | Example 1 | Example 2 | Example 3 | Example 4 |
| evacuation termination | 10 | 10 | 10 | 10 |
| injecting oxygen gas | | | | |
| initiation | 8 | 7 | 8 | 11 |
| termination | 24 | 23 | 24 | 26 |
| pouring molten metal to sleeve | | | | |
| initiation | 20 | 20 | 20 | 27 |
| termination | 22 | 22 | 22 | 28 |
| injecting molten metal to cavity | | | | |
| initiation | 24 | 23 | 26 | 29 |
| termination | 26 | 25 | 28 | 31 |
| re-evacuation | | | | |
| initiation | 24 | 23 | 24 | 29 |
| termination | 27 | 26 | 28 | 31 |
| opening dies | 70 | 70 | 75 | 75 |

(Lapsed time is reckoned from the initiation of the evacuation operation.)

The volume of residual gases contained in each of obtained die-cast products was measured by the Ransley method, and their mechanical properties were measured.

As seen in the measurement result of Table 2, as compared with that from Comparative Example 4, each of the die-cast products from Examples 1 to 3 has a remarkably reduced volume of gases such as $N_2$ and $H_2$, and exhibits higher values in elongation and tensile strength. Further, by virtue of the extremely reduced volume of gases, each of the die-cast products from Examples 1 to 3 could be improved in mechanical properties by subjecting to a heat treatment such as a T6 treatment (heating at 510 degrees centigrade for 3 hours—water quenching—aging at 1600 degrees centigrade for 5 hours) without occurrence of blisters. On the other hand, after the T6 treatment, the die-cast product from Comparative Example 4 exposed blisters at junctions of metal flows arising during the die-casting operation, and proved that some gases were incorporated therein.

TABLE 2

Influence of Difference in Manufacturing Conditions on Properties of Die-Cast Products and Die-Cast Products Subjected to T6 Treatment

| | | die-cast product (w/o heat treatment) | | die-cast product subjected to T6 treatment | | |
|---|---|---|---|---|---|---|
| Example No. | gas volume (cc/11g-Al) | tensile strength ($kg/mm^2$) | elongation (%) | tensile strength ($kg/mm^2$) | elongation (%) | note |
| 1 | 0.8 | 25 | 9 | 30 | 14 | Inventive |
| 2 | 0.9 | 25 | 11 | 30 | 15 | Example |
| 3 | 0.6 | 27 | 12 | 32 | 16 | |
| 4 | 1.8 | 24 | 7 | 28 | 10 | Comparative Example |

INDUSTRIAL APPLICABILITY

As described above, in the present invention, a die-cast product is produced by supplying molten aluminum alloy to a cavity while sequentially performing the evacuation, reactive-gas injection and re-evacuation operations with respective overlap periods therebetween. In the evacuation operation, the internal pressure of the cavity is reduced down to the vacuum of 100 millibar or lower, to discharge air from the cavity. Then, in the reactive-gas injection operation, the internal pressure of the cavity is increased to atmospheric pressure or more, to completely remove the residual air in the cavity and other gases such as water vapor attached on the inner surface of the dies. Further, the re-evacuation operation is performed in synchronous with the operation of forcibly injecting the molten aluminum alloy into the cavity to remove the unreacted reactive gas from the cavity and prevent the unreacted reactive gas from being incorporated into the molten aluminum alloy, so as to provide a die-cast product having a significantly reduced volume of gases. The die-cast product obtained in this manner is free from the casting defects such as internal porosities or blowholes caused by the incorporated gases, and can be subjected to a heat-treatment for improving its mechanical properties. Thus, the die-casting method according to the present invention can provide an improved die-cast product usable even for functional members with its intrinsic advantage of excellent productivity.

What is claimed is:

1. A die-casting method comprising the steps of:

evacuating a cavity defined by dies of a die-casting machine to provide therein a vacuum of 100 millibar or less during a first period;

injecting a reactive gas from a sleeve of said die-casting machine into said cavity during a second period which has a partial overlap period with said first period and follows said overlap period, so as to increase the inner pressure of said cavity to atmospheric pressure or more;

pouring a molten aluminum alloy into said sleeve while keeping the injection of said reactive gas, and subsequently moving a plunger in said sleeve forward to forcibly inject said molten aluminum alloy from said sleeve into said cavity, while re-evacuating said cavity through a gas passage opened to an overflow region in said cavity.

2. A die-casting method as defined in claim 1, wherein said cavity is evacuated at a suction speed of 500 millibar/second or more.

3. A die-casting method as defined in claim 1, wherein said cavity is evacuated through a runner region in said dies.

4. A die-casting method as defined in claim 1, wherein said cavity is evacuated through a runner region in said dies in addition to said overflow region.

5. A die-casting method as defined in claim 1, wherein said reactive gas is injected after being dehumidified, to keep said cavity in humidity of 15% RH or less.

6. A die-casting method as defined in claim 1, wherein said plunger is moved forward after the termination of said reactive gas injecting step.

7. A die-casting method as defined in claim 1, wherein said reactive gas injection step is continued until the completion of an entire die-casting operation.

8. A die-casting method as defined in claim 1, wherein said plunger is temporarily stopped just after a tip of said plunger tip passes over an pour opening of said sleeve.

9. A die-casting method as defined in claim 1, wherein said cavity is continuously re-evacuated until the completion of an entire die-casting operation.

10. A die-casting method as defined in claim 1, wherein said cavity is re-evacuated through said overflow region.

* * * * *